US005729610A

United States Patent [19]

Ishida

[11] Patent Number: 5,729,610

[45] Date of Patent: Mar. 17, 1998

[54] RADIO PAGING UNIT

[75] Inventor: Hiromichi Ishida, Shizuoka, Japan

[73] Assignee: NEC Corporation, Tokyo, Japan

[21] Appl. No.: 632,625

[22] Filed: Apr. 15, 1996

[30] Foreign Application Priority Data

Apr. 20, 1995 [JP] Japan ..... 7-094985

[51] Int. Cl.[6] ..... H04K 1/00

[52] U.S. Cl. ..... 380/49; 380/23

[58] Field of Search ..... 380/49, 9, 23, 380/4

[56] References Cited

U.S. PATENT DOCUMENTS 5,146,217 9/1992 Holmes et al. .
5,283,832 2/1994 Lockhart, Jr. et al. .

FOREIGN PATENT DOCUMENTS 4115729 4/1992 Japan .

*Primary Examiner*—David C. Cain
*Attorney, Agent, or Firm*—Whitham, Curtis, Whitham & McGinn

[57] ABSTRACT

In a radio paging unit, in addition to a display driver, a control system for causing a display section to display message information received via a radio reception section and saved in a message storage section includes the following sections to operate in cooperation with a control section: an encryption section for encrypting message information, a password registration section for registering a password in advance which is used to permit message contents to be disclosed to limited users, and a password collation section for collating an input password input by the user with the registered password, the control section being adapted to set a mode (normal designation mode) of performing encryption of a message on the basis of selection by the user or a mode of automatically performing encryption of all messages on the basis of automatic selection in accordance with stored encryption control information, to cancel a message encryption designation mode when the passwords coincide with each other, and to cause the display section to display a message for which the encryption mode is set after the message is encrypted by the encryption section, and to cause the display section to display a message for which the encryption mode is not set without any conversion.

2 Claims, 5 Drawing Sheets

| MEMORY No. | PASSWORD | ENCRYPTION PATTERN INFORMATION |
|---|---|---|

RADIO PAGING UNIT

BACKGROUND OF THE INVENTION

1. Field of the Invention

The present invention relates to a radio paging unit and, more particularly, to a radio paging unit which has a memory for storing received messages and a function of displaying message contents and can set and cancel an encryption mode with a simple operation to improve the security of message information.

2. Description of the Prior Art

FIG. 1 shows an example of the arrangement of a conventional radio paging unit of this type. As shown in FIG. 1, message information received from a base station (not shown) via a radio section 5 is temporarily stored in a message storage section 3. In addition, the message contents are displayed on a display section 4 through a control system 20. The user of this unit can therefore know the contents of a message from a caller by seeing the display section 4 when the user is called. Since this received message is stored in the storage section 3, the message can be displayed again when the user operates an operation section 1 to start the control system 20. As a general security means, this radio paging unit has a means for disclosing message contents or rejecting their disclosure upon collation/determination/diagnosis of a user identification number and a password. Japanese Unexamined Patent Publication No. 4-115729 proposed a disclosure rejection technique. According to this technique, received message contents are encrypted (or encoded) to be displayed upon being substituted so as to prevent the message information from being disclosed to a third party. For example, as shown in FIG. 2, according to the display management configuration in this technique, for each received message, a corresponding "memory No." is registered with one piece of encryption pattern information (substitution encryption rule) and one password assigned thereto.

In the above conventional radio paging unit, upon reception of an incoming call, a received message is unconditionally displayed on the display section 4. In addition, at a later time, the received message stored in the message storage section 3 can be easily displayed on the display section 4 with a simple operation of the operation section 1. For this reason, the security of received message information may be degraded. Assume that messages are to be encrypted to be displayed upon being substituted. In this case, since one password and a plurality of substitution encryption rules are assigned to one piece of received message information when it is registered, a plurality of passwords may be created, resulting in a burden to the user. That is, cumbersome management is required for the user to remember the password contents.

SUMMARY OF THE INVENTION

The present invention has been made in consideration of the situation in the prior art, and has as its object to provide a radio paging unit which can provide security for important message information, requires no cumbersome setting operation including complicated password setting operations in an encryption mode to improve operability, and has a function of temporarily canceling the encryption mode for received message information to further improve the security.

In order to achieve the above object, according to the main aspect of the present invention, there is provided a radio paging unit comprising input means adapted to be operated by a user to input pieces of various setting information, radio reception means for receiving control information and message information transmitted from a radio base station, message storage means for saving received message information from the radio reception means, encryption means for converting the received message information into encrypted message information, display means for visually displaying the received message information and the encrypted message information, password registration means for registering a password in advance which is used to disclose message contents to limited users, password collation means for collating an input password from the input means with the password registered in the password registration means, and control means, wherein the control means is adapted to store encryption control information for designating whether an encryption mode for message contents is designated on the basis of selection by the user or automatic selection, to allow the user to determine through the input means and the display means whether to perform encryption for each of the pieces of received message information when the encryption control information designates selection by the user, to automatically set the encryption mode of performing encryption of all the pieces of received message information when the encryption control information designates automatic selection, to cancel the encryption mode set for the received message information upon reception of a collation result indicating password coincidence from the password collation means, to cause the display means to display the received message information for which the encryption mode is set after the information is converted into encrypted message information by the encryption means, and to cause the display means to display the received message information, without any conversion, for which the encryption mode is not set.

In the main aspect of the present invention, the control means is adapted to cancel only for a predetermined period of time the encryption mode for message information, of the received message information, for which the encryption mode is set, upon reception of a collation result indicating password coincidence from the password collation means, and to set the encryption mode after the lapse of the predetermined period of time.

As is apparent from the above aspect, according to the radio paging unit of the present invention, in addition to a display driver, a control system for causing a display section to display message information received via a radio reception section and saved in a message storage section includes the following sections to operate in cooperation with the control means: an encryption section for encrypting message information, a password registration section for registering a password in advance which is used to permit message contents to be disclosed to limited users, and a password collation section for collating an input password input by the user with the registered password, the control means being adapted to set a mode (normal designation mode) of performing encryption of a message on the basis of selection by the user or a mode of automatically performing encryption of all messages on the basis of automatic selection in accordance with stored encryption control information, to cancel an encryption designation mode when the passwords coincide with each other, and to cause the display section to display a message for which the encryption mode is set after the message is encrypted by the encryption section, and to cause the display means to display a message for which the encryption mode is not set without any conversion.

Therefore, one default password can be registered in advance, and important received message information can be arbitrarily or automatically encrypted. On the other hand, a correct password must be input to cancel the message encryption designation mode.

Cumbersome setting operations including setting of complicated passwords need not be performed in the encryption mode, as compared with the prior art, and security can be provided for important received message information by displaying the information upon encryption while the operability is improved. In the encryption designation mode based on automatic selection, in particular, since newly received message information is encrypted as well as saved message information, user's secret information can be protected even if the radio paging unit is stolen or lost.

In addition, since the control means has a temporary cancellation function of canceling the encryption designation mode for a predetermined period of time and setting the mode again after the lapse of the predetermined period of time, this radio paging unit can improve the security for a received message while warranting an easy operation in checking received message contents.

The above and other advantages, features and additional objects of the present invention will become manifest to those versed in the art upon making reference to the following detailed description and accompanying drawings in which preferred embodiments incorporating the principle of the present invention are shown by way of illustrative example.

DETAILED DESCRIPTION OF PREFERRED EMBODIMENT

Figures 1, 2:
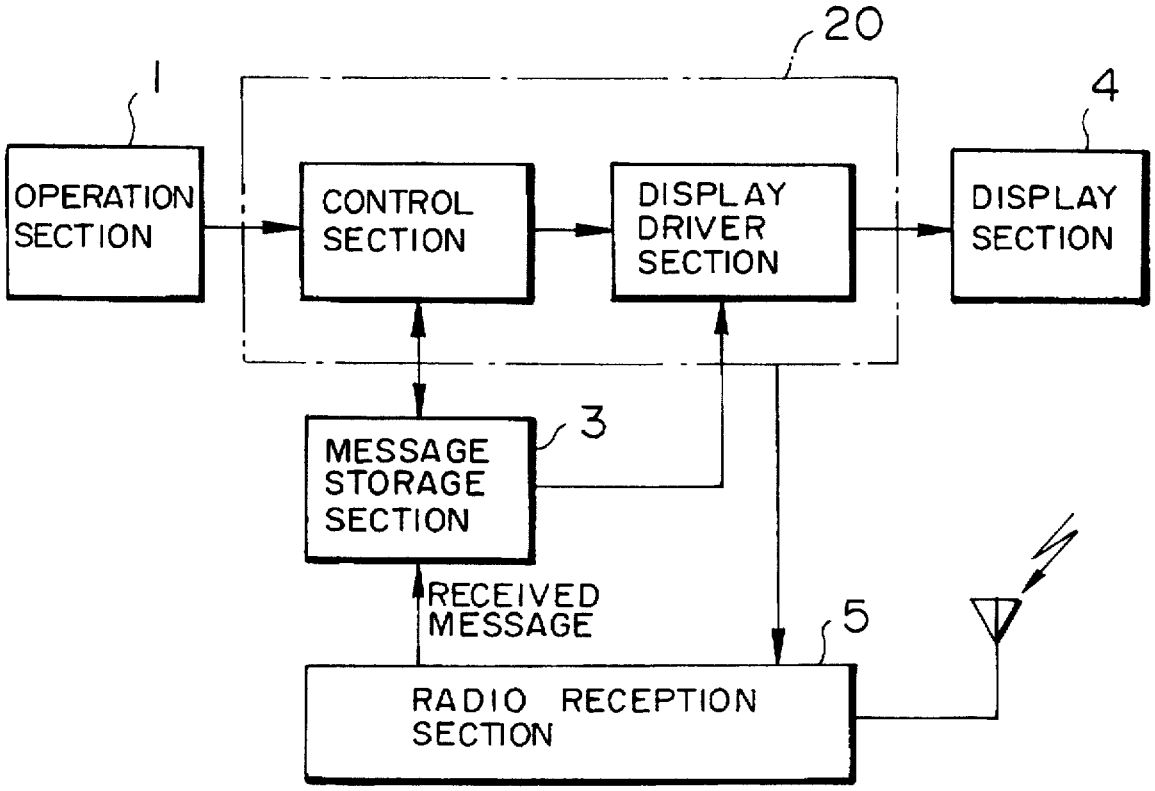
FIG. 1 PRIOR ART
FIG. 2 PRIOR ART
FIG. 1 is a block diagram showing an example of the arrangement of 8 conventional radio paging unit.
FIG. 2 is a signal plot showing an example of the format of conventional encryption information.
Figure 3:
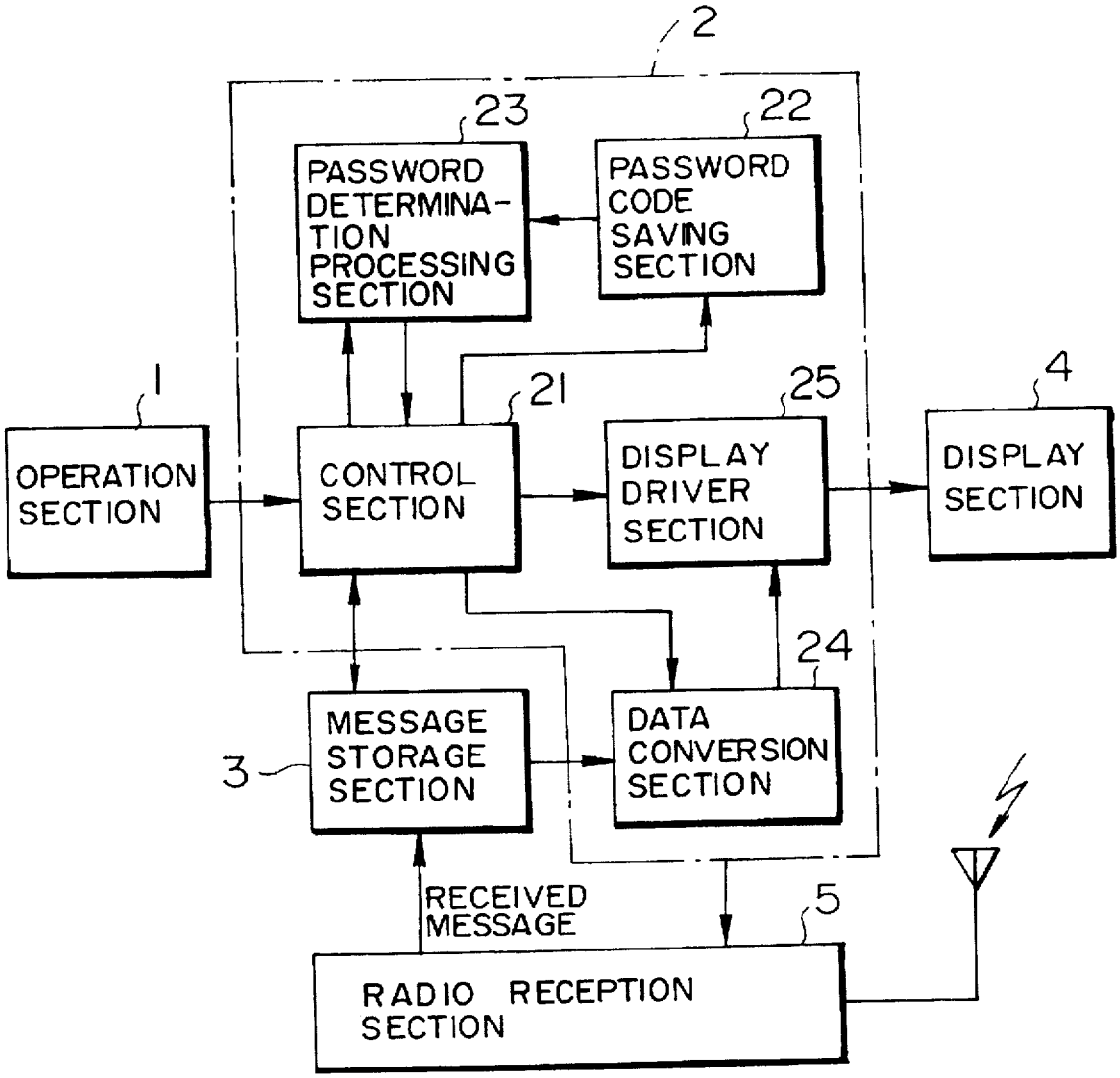
FIG. 3 is a block diagram showing the arrangement of an embodiment of the present invention.

The present invention will be described next with reference to the accompanying drawings. FIG. 3 is a block diagram showing an example of the arrangement of an embodiment of the present invention. A radio paging unit of this embodiment includes a control system 2 for controlling the overall unit, a radio reception section 5 for receiving a message from a base station by radio, a message storage section 3 for storing the message received by the radio reception section 5, a display section 4 constituted by a display device for visually displaying the characters of a message or the like, and an operation section 1 used for an input operation, e.g., setting an encryption mode. The control system 2 includes a control section 21 for controlling the overall system, a password code saving section 22 for registering/saving an identification code (password code) which permits only limited users to perform an encryption mode display operation, a password determination processing section 23 for determining coincidence of passwords to permit an encryption mode display operation while the above code is registered, a data conversion section 24 for performing code conversion of message information into encrypted data in a message encryption designation mode, and a display driver section 25 for driving the display section 4 to display a message or the like from the message storage section 3.

Figure 4:
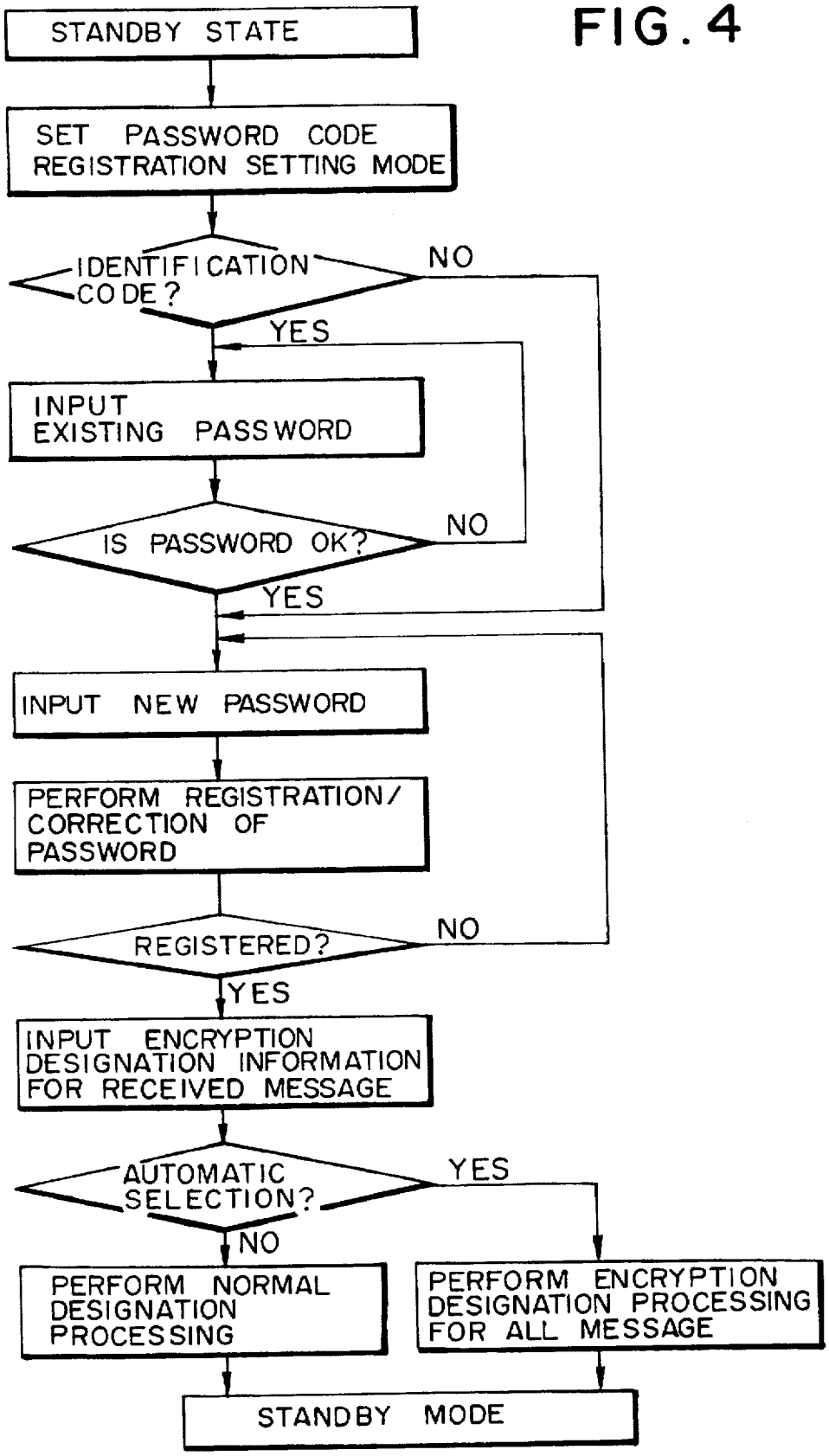
FIG. 4 is a flow chart showing a password code (user identification code) registration procedure in a radio paging unit of the present invention.
Figure 5:
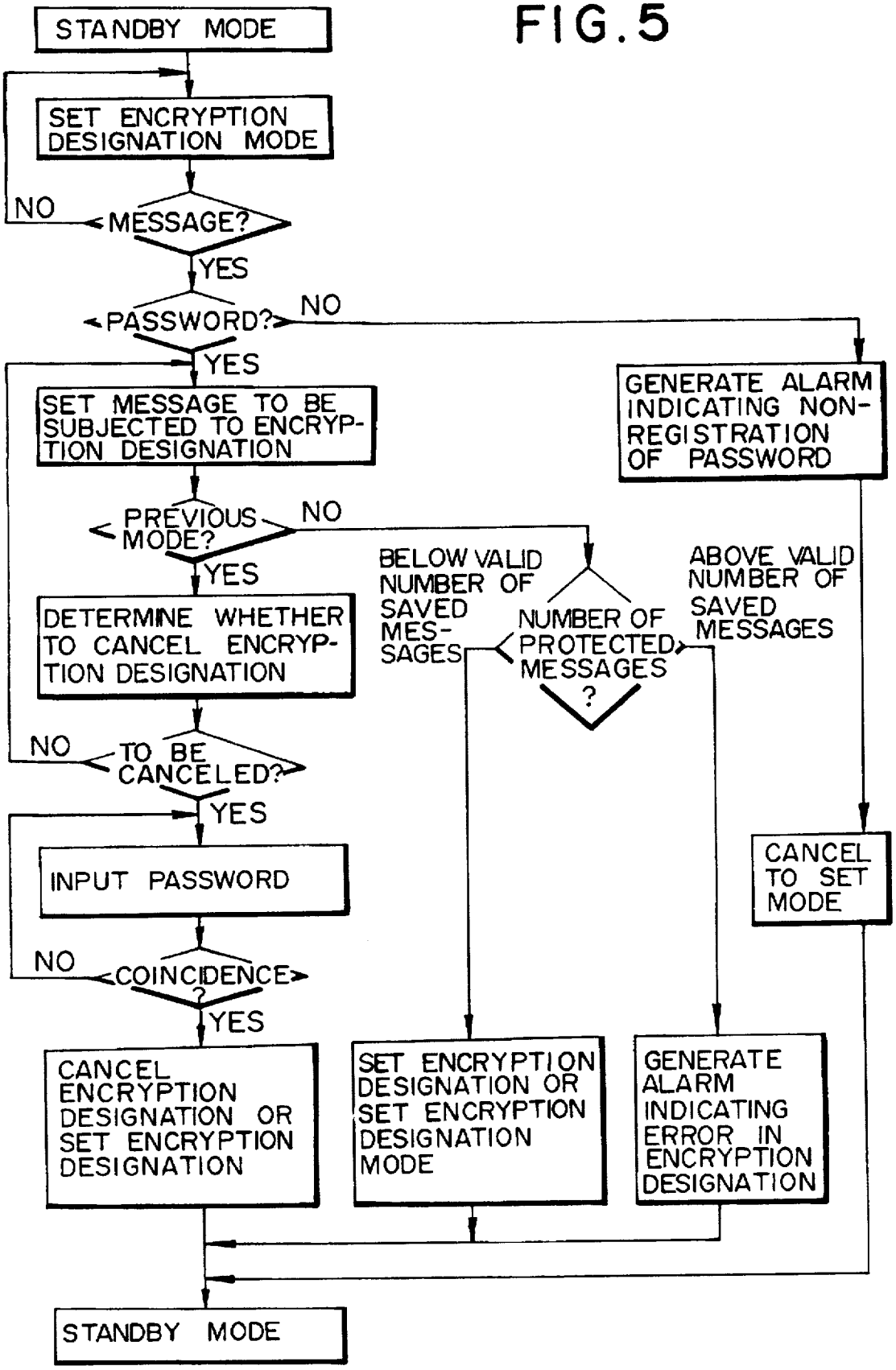
FIG. 5 is a flow chart showing procedures for setting and canceling an encryption mode for message contents in the radio paging unit of the present invention.
Figure 6:
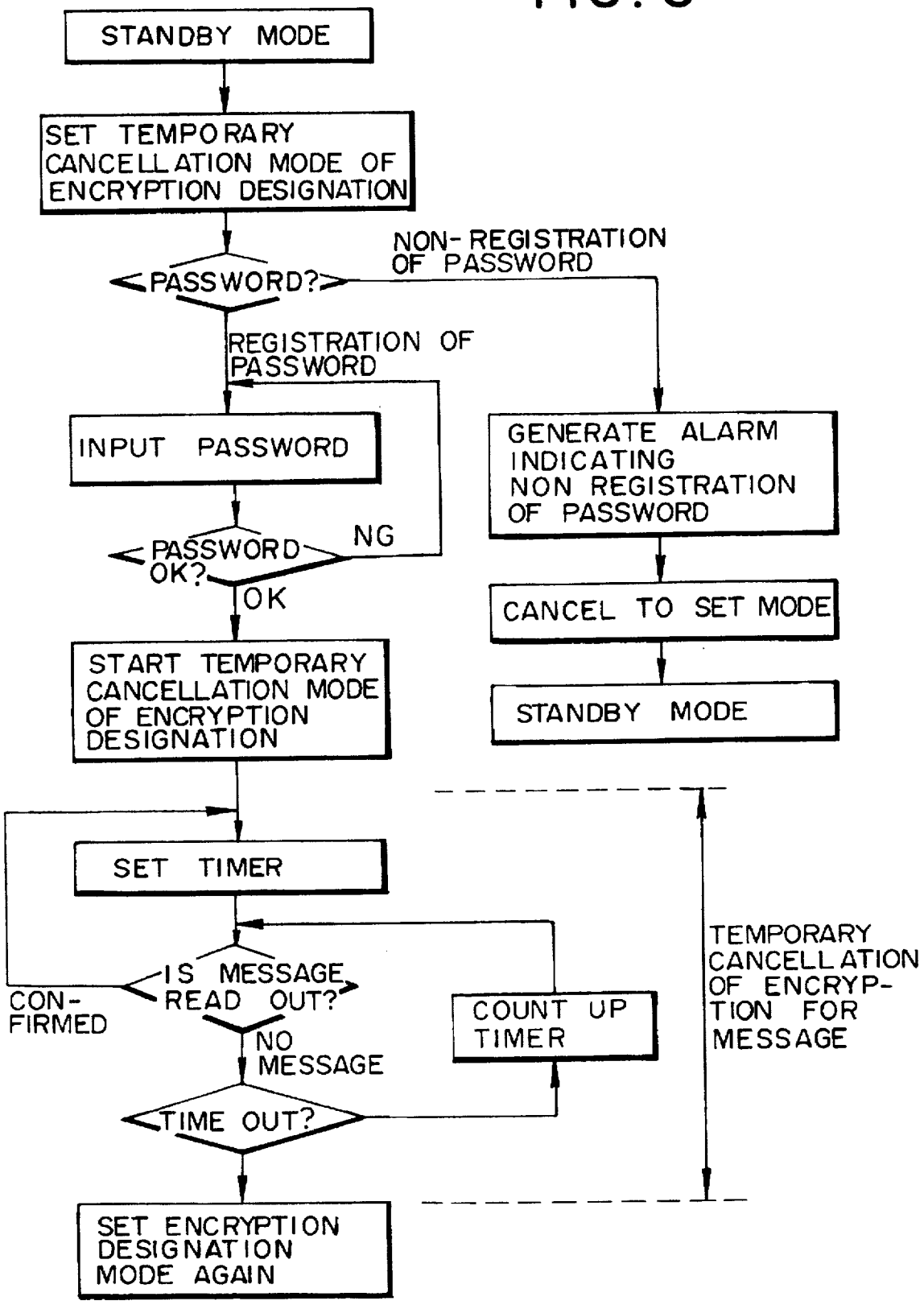
FIG. 6 is a flow chart showing a procedure for temporarily canceling an encryption designation mode in the radio paging unit of the present invention.

The operation of this embodiment will be described next with reference to the flow charts of FIGS. 4 to 6 which show procedures in the embodiment.

In order to set an initial condition in the radio paging unit of this embodiment, the user performs a key input operation with the operation section 1 to cause the control section 21 to start identification code registration control, thereby registering a password in the password code saving section 22. A registered password code can be changed in the following manner. The user inputs the existing password first. The password determination processing section 23 then performs determination processing. If the passwords coincide with each other, password correction is permitted. The user therefore inputs a new password. When registration of the password is completed, the user selects one of the following display modes: a mode of automatically performing encryption designation processing for all received messages including messages to be received in the future, and a mode of performing a normal display operation. That is, the user operates the operation section 1 to input encryption designation information for designating whether encryption of message contents is performed on the basis of selection by the user or automatic selection, and to store the information in the control section 21 (FIG. 4 shows a procedure for registering a user identification code (password code)).

When the normal display mode is selected, the user can determine execution of encryption for each received message. Assume that several messages received from the radio reception section 5 are saved in the message storage section 3 while a password has already been registered. In this case, when the user performs a key input operation with the operation section 1, the control section 21 performs control processing, from read control of received message data in the message storage section 3 to display drive control of the display driver section 25, and causes the display section 4 to sequentially display received message contents. The user sequentially checks the message contents displayed on the display section 4, and selects an arbitrary received message for which he/she wants to provide security. The control section 21 sets the encryption mode for the selected received message in the message storage section 3. The user performs a key input operation with the operation section 1 to set the encryption designation mode for the selected received messages so as to protect messages corresponding to the valid number of saved messages (FIG. 5 shows a procedure for setting the encryption mode for message contents).

When the automatic processing display mode for encryption is selected, encryption designation processing is unconditionally performed for received messages (encryption designation information is set for all received messages in the message storage section 3).

The protected messages for which the message encryption designation mode is set are always subjected to code conversion processing in the data conversion section 24 when they are read out. The resultant data is converted into image data by the display driver section 25. As a result, the contents of the received messages are displayed on the display section 4. The received message contents are therefore displayed as encrypted message contents. With this operation, security is provided for the message contents.

When the message encryption designation mode is to be canceled, the user performs a key input operation with the operation section 1 to select a target received message, and to input a password. The password determination processing section 23 then compares the input password with the registered password code. When they coincide with each other, the message encryption designation mode is canceled. The message for which the message encryption designation mode is canceled is displayed on the display section 4, without being code conversion processing in the data conversion section 24, when the message is read out. With this operation, no security is provided for the message contents until the message encryption designation mode is set again (FIG. 5 shows a procedure for canceling the encryption mode for message contents).

Assume that the user wants to provide security for the contents of a received message after he/she temporarily checks the message contents. In this case, the user can select a temporary encryption cancellation mode of temporarily canceling the message encryption designation mode only for a predetermined period of time. The procedure for this function is the same as the above procedure for canceling the message encryption designation mode. That is, the user performs a key input operation with the operation section 1 to select a target received message, and input a password. The password determination processing section 23 then compares the input password with the password registered in advance. Only when they coincide with each other, the message encryption designation mode is temporarily canceled (FIG. 6 shows a procedure for temporarily canceling the message encryption designation mode).

What is claimed is:

1. A radio paging unit comprising:

input means adapted to be operated by a user to input pieces of various setting information;

radio reception means for receiving control information and message information transmitted from a radio base station;

message storage means for saving received message information from said radio reception means;

encryption means for converting the received message information into encrypted message information;

display means for visually displaying the received message information and the encrypted message information to the user;

password registration means for registering a common password in advance which is used to disclose all message contents to limited users; password collation means for collating an input password from said input means with the password registered in said password registration means, and control means, wherein said control means receives and stores encryption control information indicating whether setting of encryption destination information to the message information is executed by a user's selection or by an automatic selection, to set encryption designation information to each of the received message information selected by the user and the message information which is not to be disclosed when the encryption control information indicates the selection by the user, to automatically set the encryption designation information to all of the message information received thereafter when the encryption control information indicates the automatic selection, to cause said display means to display the received message information for which the encryption designation information is set after the information is converted into encrypted message information by said encryption means, to cause said display means to display the received message information, without any conversion, for which the encryption designation information is not set, and to cancel all of the encryption designation information set to the received message information to enable the display means to display the message information upon reception of a collation result indicating password coincidence from said password collation means.

2. A unit according to claim 1, wherein said control means cancels only for a predetermined period of time the encryption designation information for the message information, of the received message information, for which the encryption designation information is set, upon reception of a collation result indicating password coincidence from said password collation means, and sets the encryption designation information after the lapse of the predetermined period of time.

* * * * *